United States Patent [19]

Sinisi

[11] Patent Number: 4,648,668

[45] Date of Patent: Mar. 10, 1987

[54] ZERO INSERTION FORCE CARD EDGE CONNECTOR

[75] Inventor: David B. Sinisi, Harrisburg, Pa.

[73] Assignee: AMP Incorporated, Harrisburg, Pa.

[21] Appl. No.: 878,768

[22] Filed: Jun. 26, 1986

[51] Int. Cl.[4] ..... H01R 9/09

[52] U.S. Cl. ..... 339/74 R; 339/75 MP; 339/176 MP

[58] Field of Search ..... 339/74 R, 75 MP, 176 MP

[56] References Cited

U.S. PATENT DOCUMENTS

| | | | |
|---|---|---|---|
| 3,475,717 | 10/1969 | Lane | 339/75 MP |
| 3,526,869 | 9/1970 | Conrad et al. | 339/176 MP |
| 3,982,807 | 9/1976 | Anhalt et al. | 339/75 MP |
| 4,021,091 | 5/1977 | Anhalt et al. | 339/75 MP |
| 4,169,644 | 10/1979 | Bonhomme | 339/75 MP |
| 4,548,452 | 10/1985 | Gillett | 339/75 MP |
| 4,553,804 | 11/1985 | Lapraik et al. | 339/75 MP |
| 4,586,772 | 5/1986 | Cobaugh et al. | 339/75 MP |

FOREIGN PATENT DOCUMENTS

| | | | |
|---|---|---|---|
| 2431767 | 1/1975 | Fed. Rep. of Germany | 339/176 MP |

*Primary Examiner*—John McQuade

*Attorney, Agent, or Firm*—Allan B. Osborne

[57] ABSTRACT

A zero insertion force card edge connector for mounting on a backplane and receiving therein a daughter card whereby circuits on the backplane and card are electrically interconnected through contact members in the connector. More particularly, the connector includes cam members, slidably mounted between an upper and lower housing for driving spring arms on the contact members into engagement with conductive pads on thedaughter card. The cam members further move the upper housing downwardly, in cooperation with the spring arms which are preloaded in the connector, to remove restraining members which otherwise restrain the spring arms from entering the card slot and engaging the conductive pads.

22 Claims, 23 Drawing Figures

170
36
10
16
212
38
174
168
150
210
160
34
162
172
202
194
142
154
192
188
186
166
208
152-f
152-r
144
146
206
152-r
152-f
204
138
148
68
66
74
55
140
98
44
52
140
50
84
136
92
72
90
80
70
76
28
54
98
42
104
94
44
64
106
32
56
62
82
30
58
54
96
106
108
60
108
110
40
48
46
110

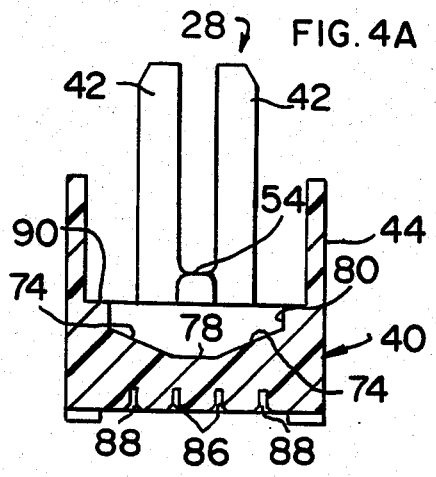
FIG. 4A
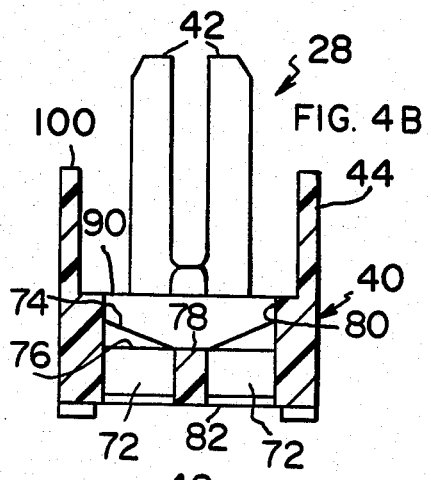
FIG. 4B
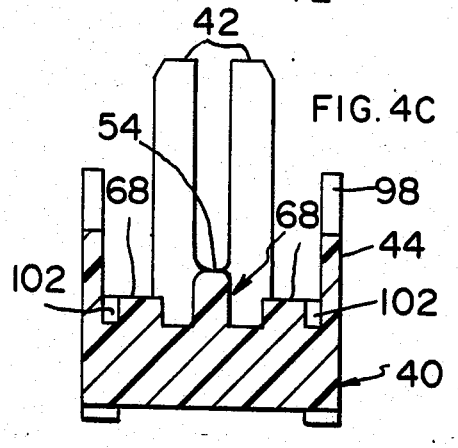
FIG. 4C
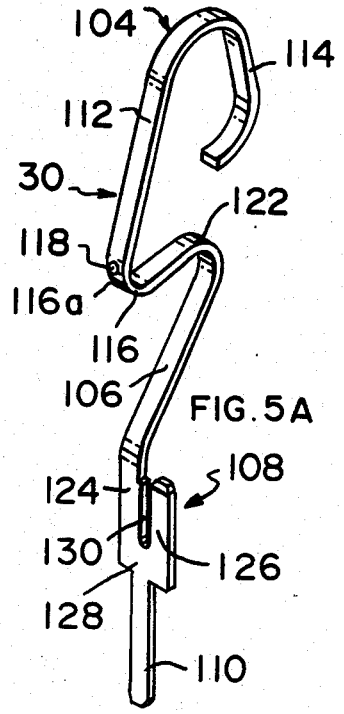
FIG. 5A
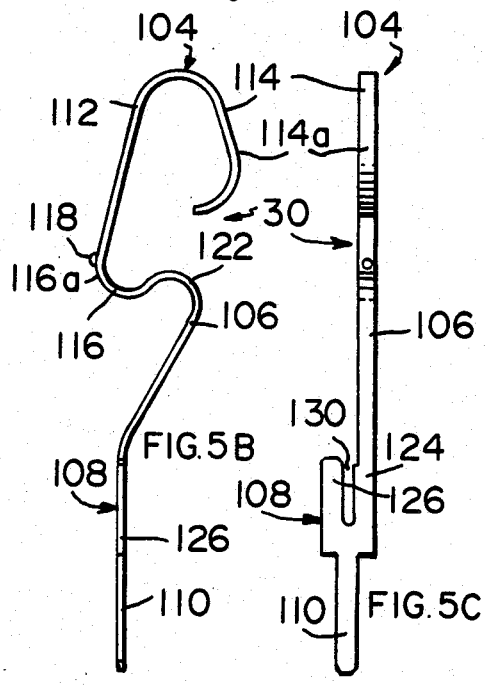
FIG. 5B
FIG. 5C

ZERO INSERTION FORCE CARD EDGE CONNECTOR

FIELD OF THE INVENTION

The present invention relates to card edge connectors for electrically interconnecting a printed circuit daughter card to a printed circuit mother board or backplane.

BACKGROUND OF THE INVENTION

Mainframe manufacturers and the telecommunications industry are primary users of backplanes on which are mounted a substantial number of daughter cards carrying electronic components thereon. The backplane provides conductive traces or circuits to electrically interconnect the components on the several cards and to provide access to other backplanes and outside electric gear. The predominate method of mounting the cards on the backplane and electrically interconnecting the circuits (and hence the components) is by means of card edge connectors. Such connectors include a card receiving slot, i.e. a card slot, with conductive contact members having spring arms or cantilever beams positioned along one or both sides of the slot to engage traces on the card inserted therein and further having depending leads electrically engaging the backplane. In some connectors, the arms or beams are preloaded into the slot and the cards are frictionally inserted thereinto. Provided the number of contact members are not too great, the force required to insert the card is acceptable. However, cards having a large number of traces require connectors wherein the large number of contact members prohibit frictional insertion. In these cases, connectors having camming mechanisms which either cam the arms or beams out of the slot prior to inserting the card, e.g. as disclosed in U.S. Pat. No. 3,793,609, or into the slot after insertion of the card, e.g. as disclosed in U.S. Pat. No. 4,586,772, are used.

In each type connector, the method of obtaining the normal force, i.e. the force exerted on the conductive pads or traces on the card by the arms or beams, predetermines the type of cantilever beam or spring arm to be used therein. For example, in the first type, the spring arms must be resilient enough so that they can be moved out of the slot with acceptable levels of force applied to the camming mechanism and still have sufficient inherent spring force to bear against the card and obtain good electrical contact therewith. In the second type of ZIF connector, the spring arms or beams must be made of stiffer material to stand up under the biasing forces continually exerted against them by the camming mechanism. In this type connector, a higher normal force may be obtained which is required in some operational uses. However, a greater force is required to actuate the camming mechanism which could lead to breakage if the components are not strong enough to withstand the forces.

It is now proposed to provide a ZIF card edge connector wherein the spring arms on the contact members are hinged and have a large moment arm which provides a mechanical advantage so that lower forces will actuate the camming mechanism and a high normal force will still be obtained.

SUMMARY OF THE INVENTION

According to the present invention, a zero insertion force, card edge connector is provided having a dielectric lower housing in which conductive contact members are positioned. Each contact member includes a lead at one end which extends outwardly from the lower housing to engage conductive circuits on a backplane on which the connector would be mounted and a hinged C-shaped spring arm at another end which is received in a dielectric upper housing with a contact point on the arm facing into a card slot in the upper housing and a bearing portion on the free end of the arm which engages a cam member slidably mounted between the upper and lower housings. The spring arms include an elongated portion which increases the length thereof between the hinge point and bearing portion to provide a mechanical advantage in compressing the spring arms. Cam grooves cooperate with cam followers on the cam members so that by moving the cam members longitudinally, they move laterally inwardly against the bearing portion, compressing the spring arms and exerting a high normal force against conductive pads on a daughter card through engagement therewith by the contact point. Further, on half of the contact members, the contact points are at one vertical location with respect to the card slot and on the other half, the contact points are at another vertical location. This staggered arrangement accommodates daughter cards having two rows of conductive pads on each side with the pads in one row staggered with respect to the pads in the other row and with the row on one side staggered with respect to the rows on the other side.

BRIEF DESCRIPTION OF THE DRAWINGS

FIGS. 4A, 4B and 4C are cross-sectional views taken along lines 4A—4A, 4B—4B and 4C—4C respectively of FIG. 3A;

FIGS. 5A, 5B and 5C are perspective, side and back views respectively of one contact member of the connector;

DESCRIPTION OF THE INVENTION

Figure 1:
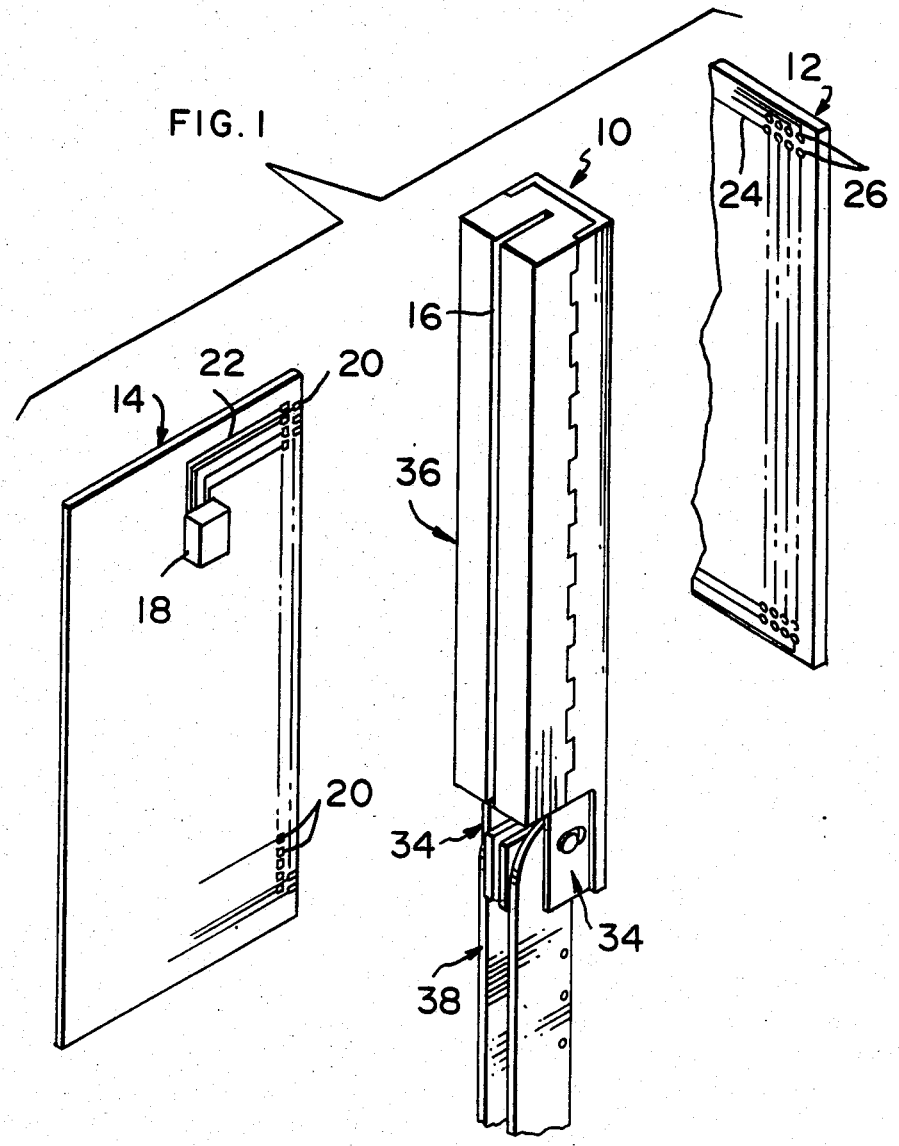
FIG. 1 is a perspective view showing the ZIF card edge connector of the present invention and the backplane and daughter card electrically interconnected through the connector.

The drawing in FIG. 1 shows the preferred embodiment of the ZIF card edge connector 10 of the present invention. Also shown is backplane 12 on which connector 10 would be mounted and daughter card 14 which would be received in card slot 16 in connector 10 whereby electronic component 18, connected to conductive pads 20 by conductive traces or circuits 22 on card 14, would be electrically connected to conductive circuits 24 on backplane 12 via conductive members (shown in other Figures) in connector 10 electrically engaging pads 20 at one end and plated-through holes 26 in backplane 12 to which circuits 24 are connected, at another end. In a typical situation, backplane 12 would have a number of connectors 10 mounted thereon with cards 14 therein electrically interconnected through connectors 10 and circuits 24.

As shown, conductive pads 20 on daughter card 14 are arranged in two rows with pads 20 in one row offset or staggered relative to pads 20 in the adjacent row. Pads 20 on the reverse side (not shown) are similarly arranged but the rows are staggered with respect to the rows shown; i.e., on the opposite side, pads 20 in the upper row are shifted to the left by one location relative to pads 20 in the lower row.

Figure 2:
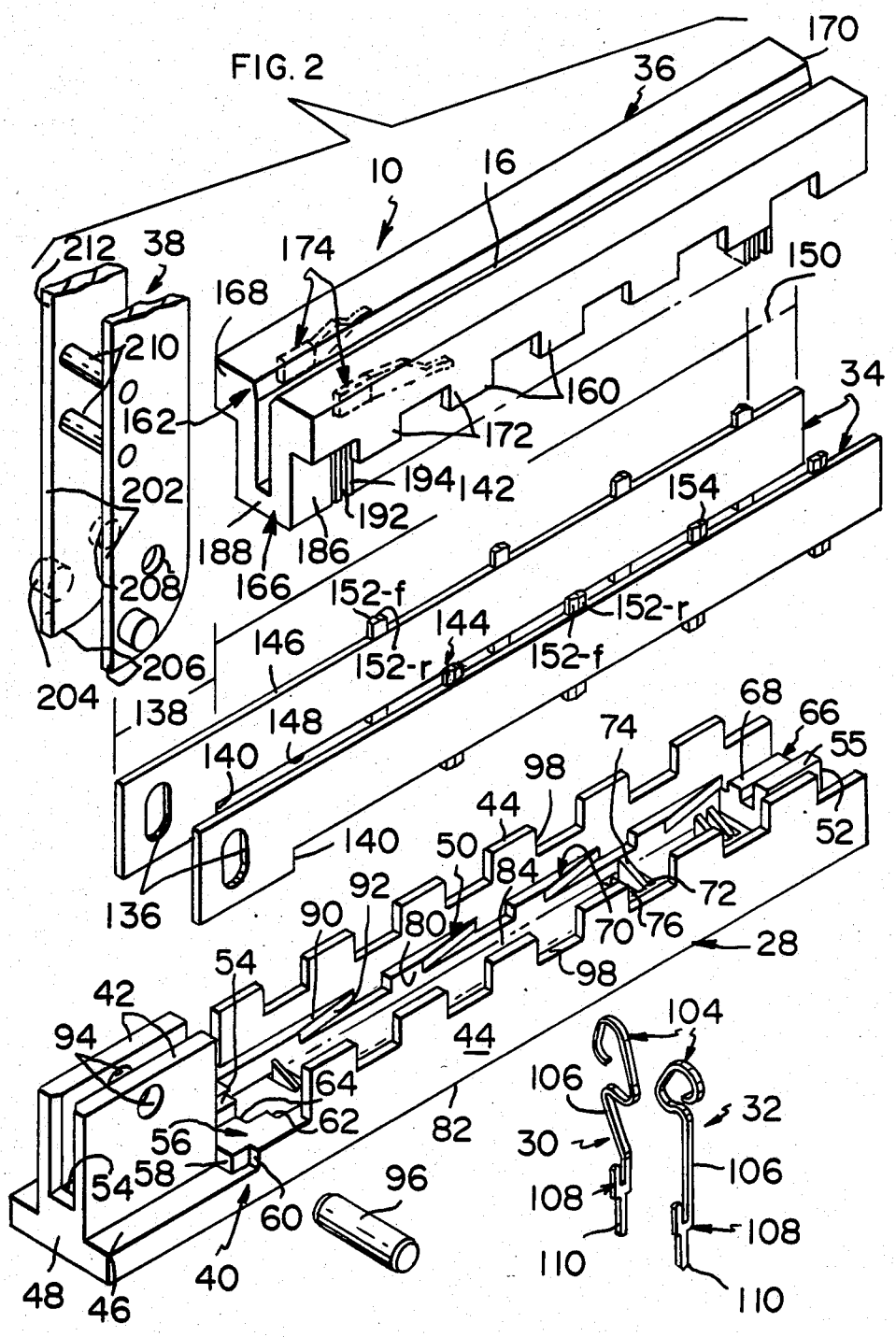
FIG. 2 is an exploded perspective view of the connector.

In FIG. 2, connector 10 is shown with the several components exploded with respect to each other. The components include lower housing 28, contact members 30, 32, two cam members 34, upper housing 36, and actuating lever 38.

Contact members 30, 32 are preferably stamped and formed from beryllium copper alloy. Cam members 34 are formed from a rigid material such as stainless steel in which case it would be covered with an insulating material such as a polyimide film. The remaining members are preferably molded, a suitable material being a polyphenylene sulfide plastic.

Lower housing 28 includes base 40, handle retaining plates 42, and sidewalls 44.

Figure 3A:
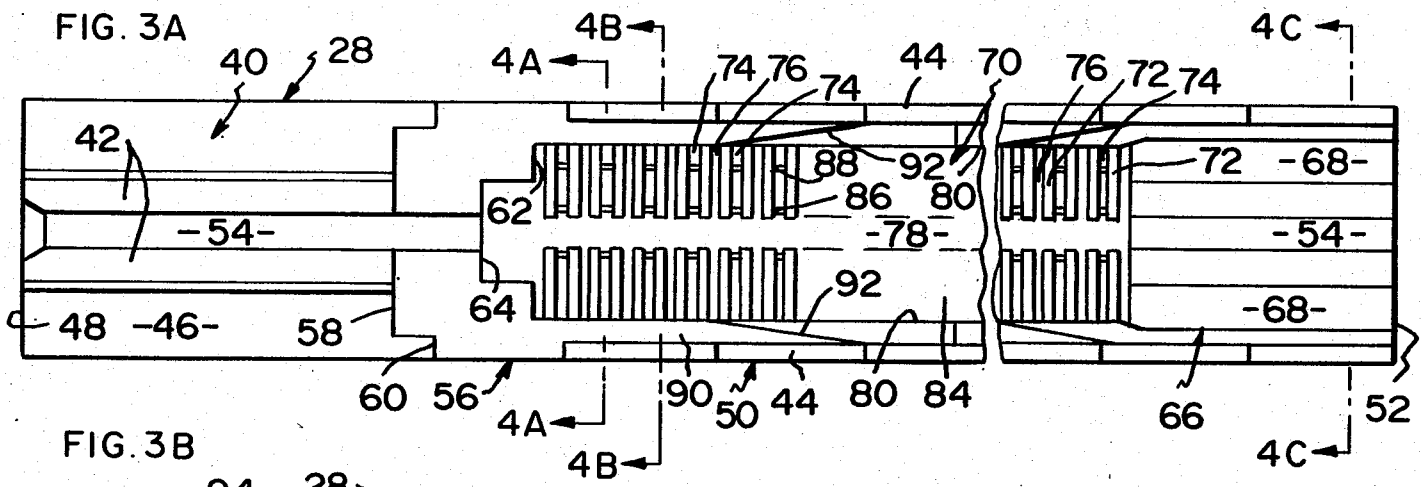
FIG. 3A is a top plan view of the lower housing of the connector.
Figure 3B:
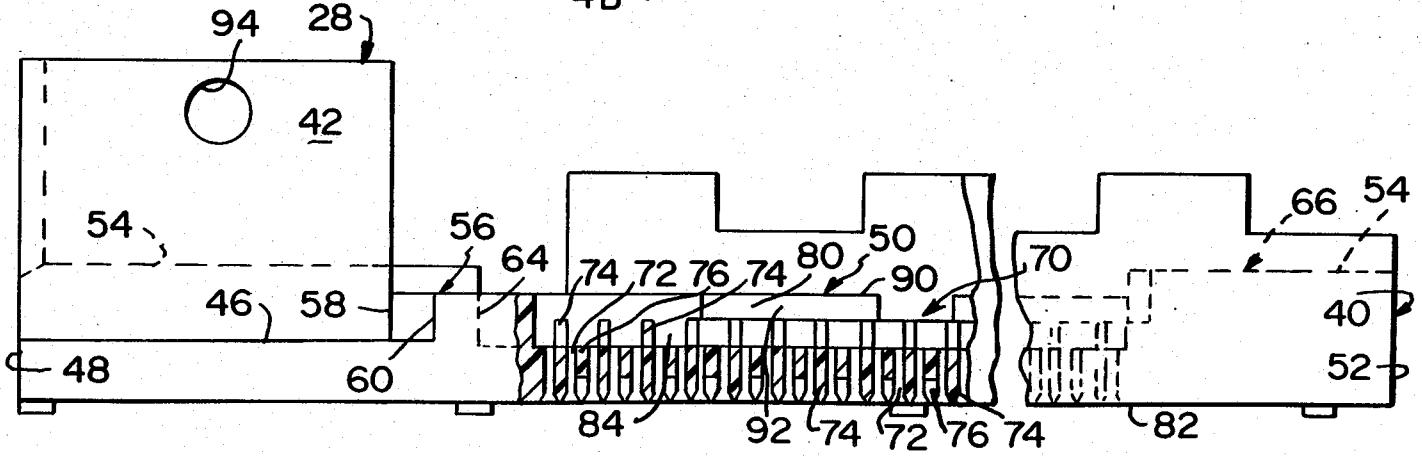
FIG. 3B is a side, partly sectioned view of the lower housing.

With reference to FIGS. 2, 3A and 3B, base 40 includes front section 46 which begins at lower housing front end 48, and back section 50 which extends rearwardly from front section 46 to lower housing rear end 52.

Front section 46 supports the two parallel spaced-apart handle retaining plates 42 between which is located a front segment of card floor 54.

Card floor 54 continues rearwardly from between plates 42 out onto a front raised portion 56 of back section 50. Raised portion 56, located immediately behind front section 46, defines forwardly facing, offset shoulders 58, 60 positioned on each side of plates 42 and further defines rearwardly facing shoulders 62 and 64. The front segment of card floor 54 ends at shoulder 64.

A rear raised portion 66, located adjacent lower housing rear end 52, supports a rear segment of card floor 54 and, on each side thereof, cam member support blocks 68.

Conductive member retaining portion 70 extends between raised portions 56, 66 and includes transverse slots 72, two longitudinal rows of transverse walls 74, 76 defined by slots 72, longitudinal center member 78 (FIG. 3A), and opposing side members 80 which are against respective sidewalls 44 of lower housing 28.

Slots 72 extend vertically through retaining portion 70, opening out onto underside 82 of base 40, i.e. lower housing 28, and onto floor 84 of retaining portion 70.

Figure 7:
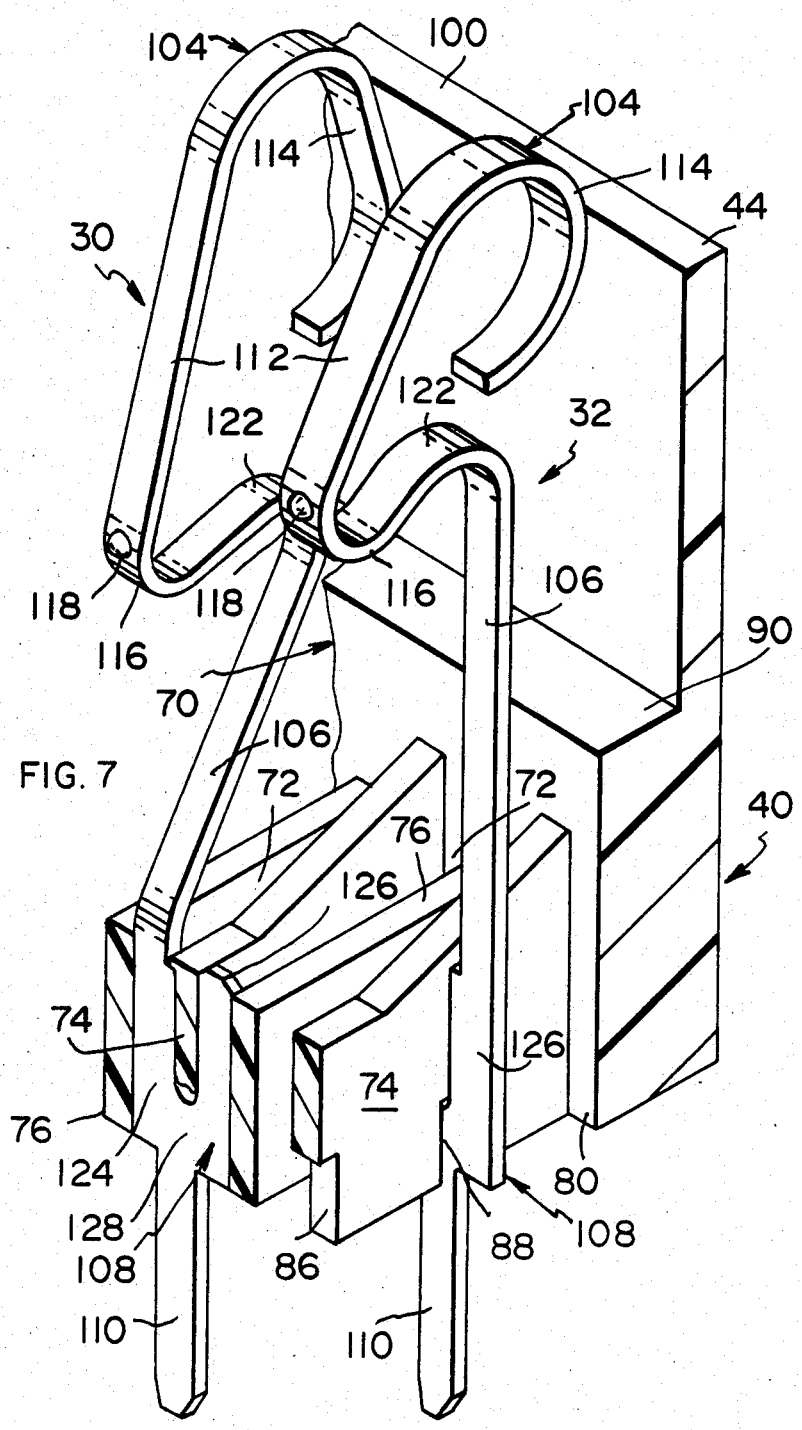
FIGS. 7 and 8 are perspective, partly sectioned views showing the positioning of the two contact members in the lower housing.
Figure 8:
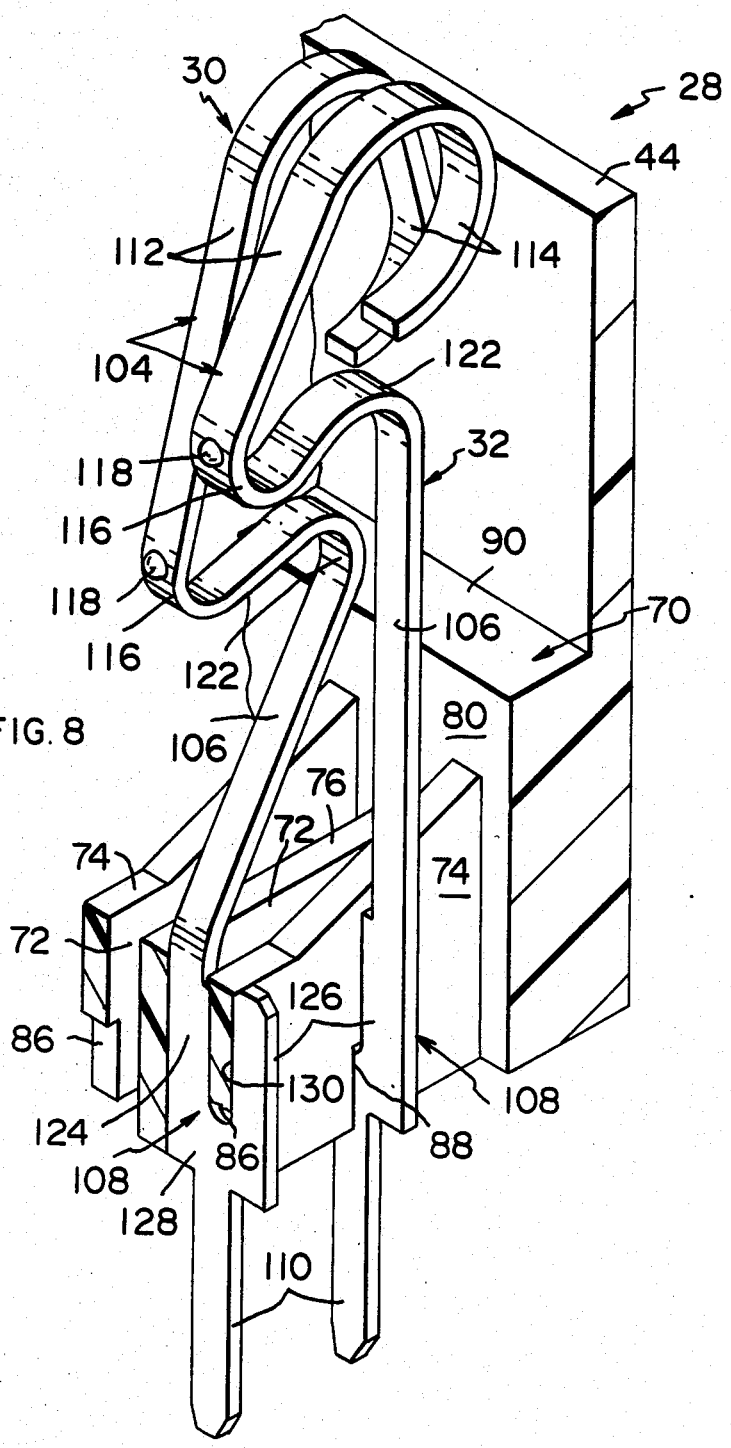

As shown clearly in FIGS. 7 and 8, transverse walls 74 alternate with transverse walls 76 in each row. Spaced-apart slits 86, 88 are provided in each wall 74 and open out onto underside 82. Slits 86 are located next to center member 78 and slits 88 are located near side members 80. Transverse walls 74 are shown extending further upwardly than do walls 76. The added material provides additional anchorage to side members 80 and thus strengthens walls 74. Walls 76 could likewise be strengthened if required or desired.

As shown in FIGS. 2 and 3A, upper edges 90 of side members 80 are notched at spaced intervals along the length thereof to provide beveled cam surfaces 92 facing in towards center member 78. Edges 90 are coplanar with front raised portion 56 and also cam member support blocks 68 on rear raised portion 66.

As shown in FIG. 2, handle retaining plates 42 are provided with aligned holes 94 in which is received pin 96.

Sidewalls 44, which are provided with upwardly open notches 98, are positioned along each side of base 40 and extend from front raised portion 56 rearwardly to lower housing rear end 52.

FIGS. 4A, 4B and 4C are cross-sectional views taken across lower housing 28 at different locations as indicated in FIG. 3A. FIG. 4A is taken across transverse walls 74 showing slits 86, 88. FIG. 4B is taken across slots 72 showing transverse walls 76 in front of transverse walls 74. FIG. 4C is taken across rear raised portion 66 showing grooves 102 between support blocks 68 and side walls 44.

As shown in FIG. 2, contact members 30, 32 each include a general C-shaped spring arm 104, intermediate strap 106, retention section 108, and pin or lead 110.

With reference to contact member 30, shown in FIGS. 5A, 5B and 5C, C-shaped spring arm 104 includes an elongated center portion 112, which is at an oblique angle relative to the axis of members 30, 32, a bent-over bearing portion 114 extending from one end of portion 112, and a first arcuate portion 116 at the lower end of portion 112 which provides a hinge for spring arm 104. An embossed contact point 118 is provided on the arcuate surface of portion 116. A second arcuate portion 122, which forms the lower portion of spring arm 104 and provides a secondary hinge therefor, connects to intermediate strap 106.

Retention section 108 is U-shaped with legs 124, 126 and bight 128 defining upwardly open slot 130 therebetween. Strap 106 is connected to leg 124 of contact member 30 and extends upwardly therefrom at an oblique angle. Lead 110, connected to bight 128, is shown as a straight pin which is received and soldered in hole 26 in backplane 12. Alternatively, lead 110 could have the compliant section shown and disclosed in U.S. Pat. No. 4,186,982, incorporated herein by reference, for an interference fit in hole 26 or a foot (not shown) adapted for surface pressure attachment or soldering to a conductive pad (not shown) on backplane 12.

Figure 6A:
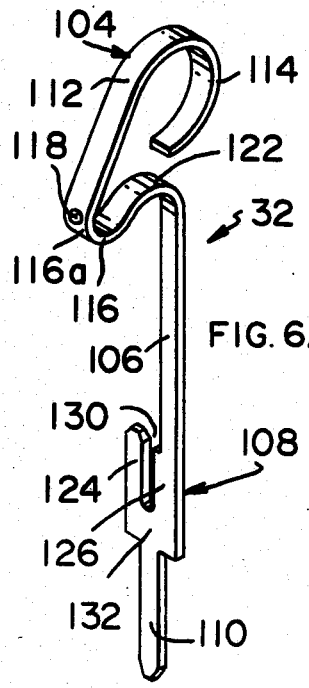
FIGS. 6A, 6B and 6C are perspective, side and back views respectively of the second contact member of the connector.
Figure 6B:
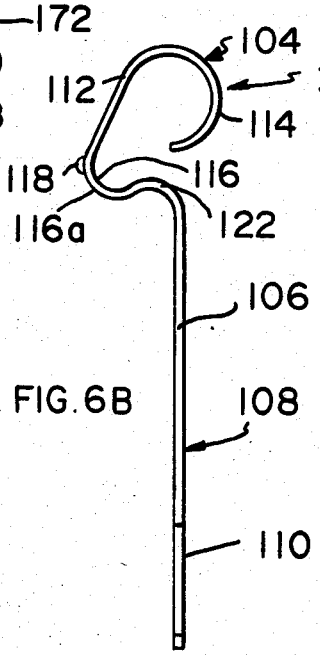
Figure 6C:
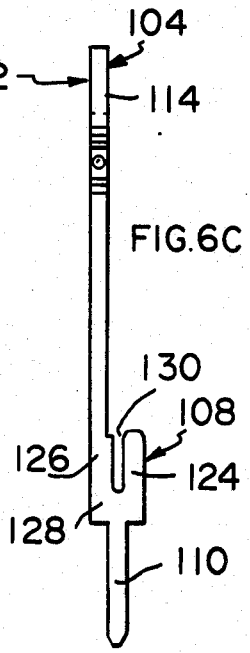

Contact member 32, shown in FIGS. 6A, 6B and 6C, is very similar to contact member 30 with these differences: center portion 112 of spring arm 104 is shorter in length on member 32; bearing portion 114 includes a straight link 114*a* on member 30 while bearing portion 114 on member 32 is arcuate; intermediate strap 106 is longer on member 32, is attached to leg 126 rather than leg 124, and extends straightaway therefrom. These differences are dictated by the need to place contact point 118 on contact member 32 higher up on that member relative to locating contact point 118 on member 30 while keeping the heights of the two members 30, 32 substantially the same.

In the description immediately following, where a component of one or the other contact member 30, 32 is being discussed, it will be further designated by a dash mark and either 30 or 32 as appropriate; e.g., contact point 118 of member 32 will be designated simply as contact point 118-32. No such designation will be used where the same components of both members 30, 32 are being discussed, e.g. spring arm 104 of contact members 30, 32.

FIGS. 7 and 8 show the positioning and retention of contact members 30, 32 in retaining portion 70 of lower housing 28. Each transverse wall 74 receives one each of members 30, 32 with member 30 being received in slit 86 next to center member 78 and member 32 being received in slit 88 near side member 80. In FIG. 7, member 30 is shown in one wall 74 and member 32 is shown in the next wall 74 for illustrational purposes, while in FIG. 8 the two members 30, 32 are shown positioned on one wall 74 as described above.

Contact members 30, 32 are frictionally retained in lower housing 28 by slots 130 extending along walls 74 in an interference fit as retaining sections 108 are pushed into respective slits 86, 88 from below base 40. As shown, bights 128 occupy slits 86, 88 and intermediate straps 106 of members 30, 32 on the same wall 74 are on opposite sides thereof by reason of being attached to respective legs 124, 126 of retaining section 108. In positioning members 30, 32, spring arms 104 and straps 108 pass through slots 72. Intervening transverse walls 76 isolate members 30, 32 on adjacent walls 74. Contact points 118 on spring arms 104 face in towards the longitudinal center of lower housing 28. Bearing portions 114 face outwardly towards sidewalls 44. As shown, spring arms 104 are located above edge 90 of side members 80.

As noted above, contact point 118-32 is higher than contact point 118-30.

Accordingly, with members 30, 32 positioned on a wall 74 as shown in FIG. 8, contact point 118-32 is displaced vertically above contact point 118-30. Thus, all contact points 118-32 along each row occupy one spatial location and contact points 118-30 occupy another spatial location, thereby providing an alternating or vertically staggered arrangement. This arrangement reflects the spatial location of conductive pads 20 along the edge of daughter card 14 as shown in FIG. 1.

Although the opposing or second row is not shown, it can be ascertained from FIGS. 7 and 8 that intermediate straps 106 of members 30, 32 in the opposite row extend alongside an opposite side of walls 74 therein; i.e., the contact members 30, 32 in one row are a mirror image of members 30, 32 in the opposing row. Thus, contact points 118-30 in one row directly face contact points 118-32 in the opposite row to provide a vertically staggered arrangement in the transverse plane also.

Figure 11:
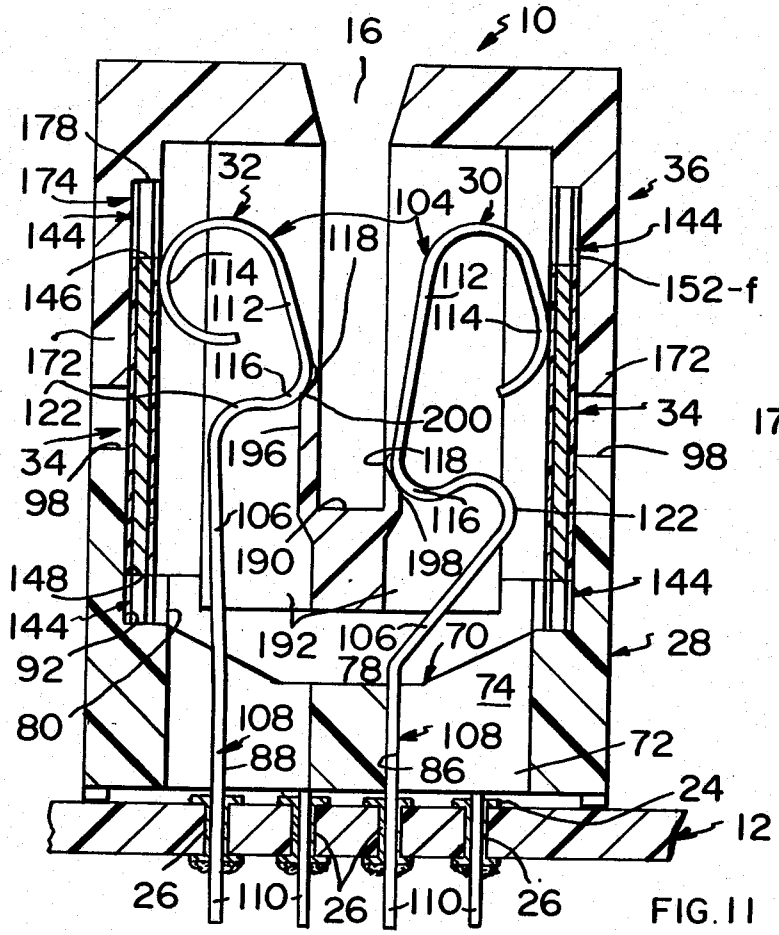
FIG. 11 is a cross-sectional view of the connector in an open state.

FIG. 11 clearly illustrates the vertical displacement of contact point 118-30 relative to opposing or facing contact point 118-32. The staggered transverse arrangement reflects the location of conductive pads 20 on the opposite side (not shown) of daughter card 14 which is a reverse pattern to the side shown in FIG. 1.

The aforementioned staggered arrangement of contact members 30, 32 also avoids facing spring arms from touching each other in the event connector 10 is closed (FIG. 13) without daughter card 14 in card slot 16.

Although contact points 118 of contact members 30, 32 are in a staggered arrangement, leads 110 of members 30, 32 define a symmetrical grid of four rows extending outwardly from underside 80 of lower housing 28. The precise pattern is reflected in the pattern of plated-through holes 26 in backplane 12 shown in FIG. 1. However, leads 110 could be located differently if desired to accommodate other hole or pad patterns (not shown).

With reference to FIG. 2, elongated cam members 34 include oval-shaped holes 136 located in front portion 138 thereof, rearwardly facing shoulders 140 on bottom edge 148 marking the juncture between front portions 138 and mid-portions 142, a plurality of spaced-apart cam followers 144 projecting outwardly along mid-portion 142 from both top and bottom edges 146, 148 respectively thereof and beyond the last cam followers 144 on the right-hand side, rear portions 150.

The side surfaces of cam followers 144 which face outwardly towards sidewalls 44 when members 34 are assembled in lower housing 28, as shown in FIG. 11, have a double bevel; i.e., each half slants in from the middle of the side surface to the ends to provide beveled surfaces 152-*f* and 152-*r*. Also, the rear half of the face of cam followers 144 on top edge 146 slant towards that edge to provide beveled surface 154.

Figure 13:
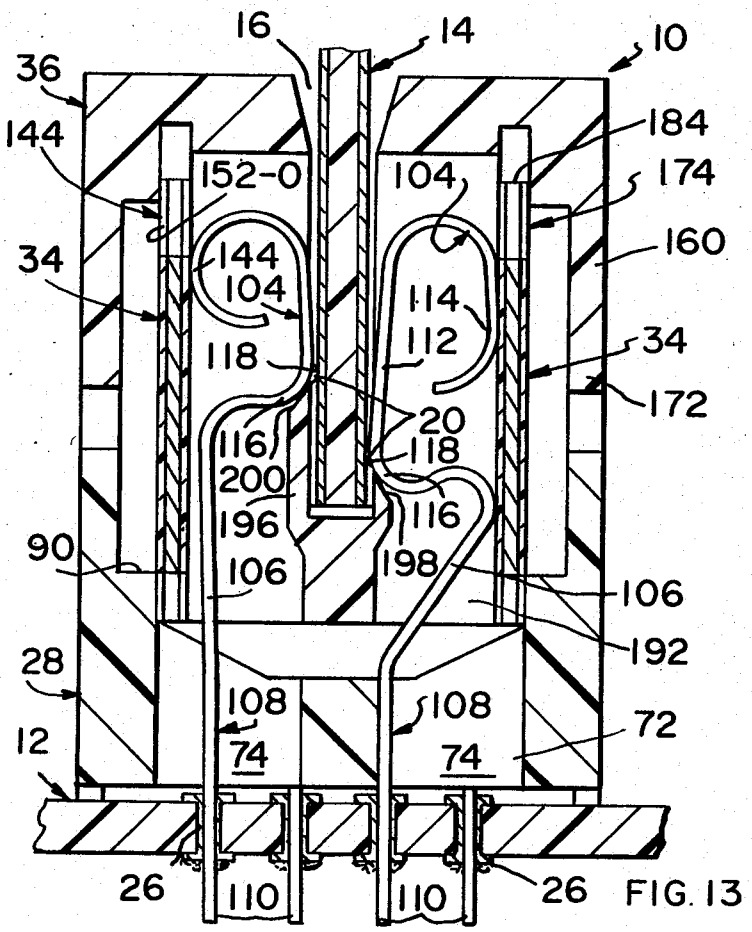
FIG. 13 is a cross-sectional view of the connector in a closed state.

Cam members 34 are slidingly positioned in lower housing 28 with mid-portions 142 being between sidewalls 44 and bearing portions 114 of contact members 30, 32, as shown in FIGS. 11 and 13. Front portions 138 of members 34 slide on front section 46 of base 40 on each side of plates 42. Mid-portions 142 slide on front raised portion 56 and edges 90 of side members 80. As cam members 34 are moved forward towards lower housing front end 48, they move laterally inwardly partly through cooperation between cam surfaces 92 and beveled surfaces 152-*f*, as will be described below. As cam members 34 move inwardly, they move free from the support of edges 90 but gain support from rear portions 150 sliding onto support blocks 68 on the rear raised portion 66. Forward travel of members 34 is limited by the leading cam followers 144 on bottom edges 148 abutting rearwardly facing shoulders 62 of the front raised portion 56. Rearward travel is limited by rearwardly facing shoulders 140 on cam members 34 abutting forwardly facing shoulders 58 on raised portion 56.

Figure 10B:
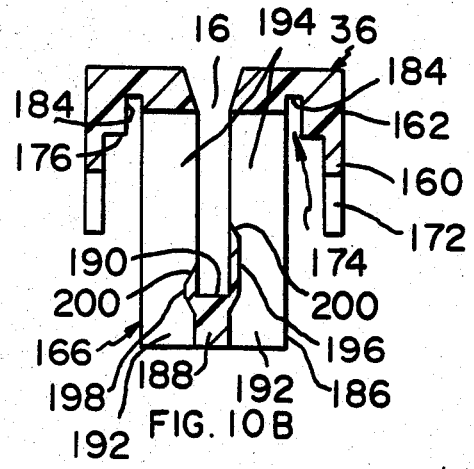
FIGS. 10A and 10B are cross-sectional views of the upper housing taken along lines 10A—10A and 10B—10B of FIG. 9B.
Figure 10A:
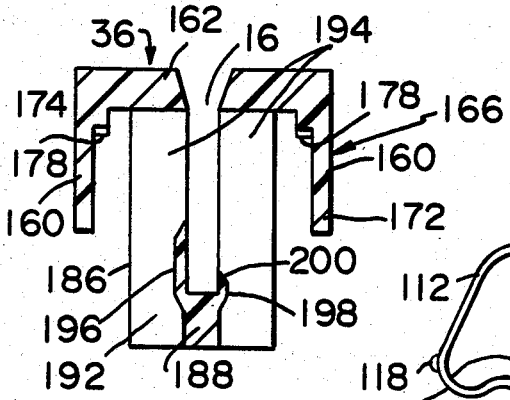

Upper housing 36, as shown in FIGS. 2, 10A and 10B, is T-shaped as viewed from one end with depending skirts 160 provided at the lateral edges of cross member 162. The aforementioned card slot 16 longitudinally bisects cross member 162 and extends into body 166, opening out at both upper housing front end 168 and rear end 170.

Skirts 160 are notched to define members 172 which, as shown in FIG. 1, are received in upwardly open notches 98 in side walls 44 of lower housing 28.

Figures 9A, 9B:
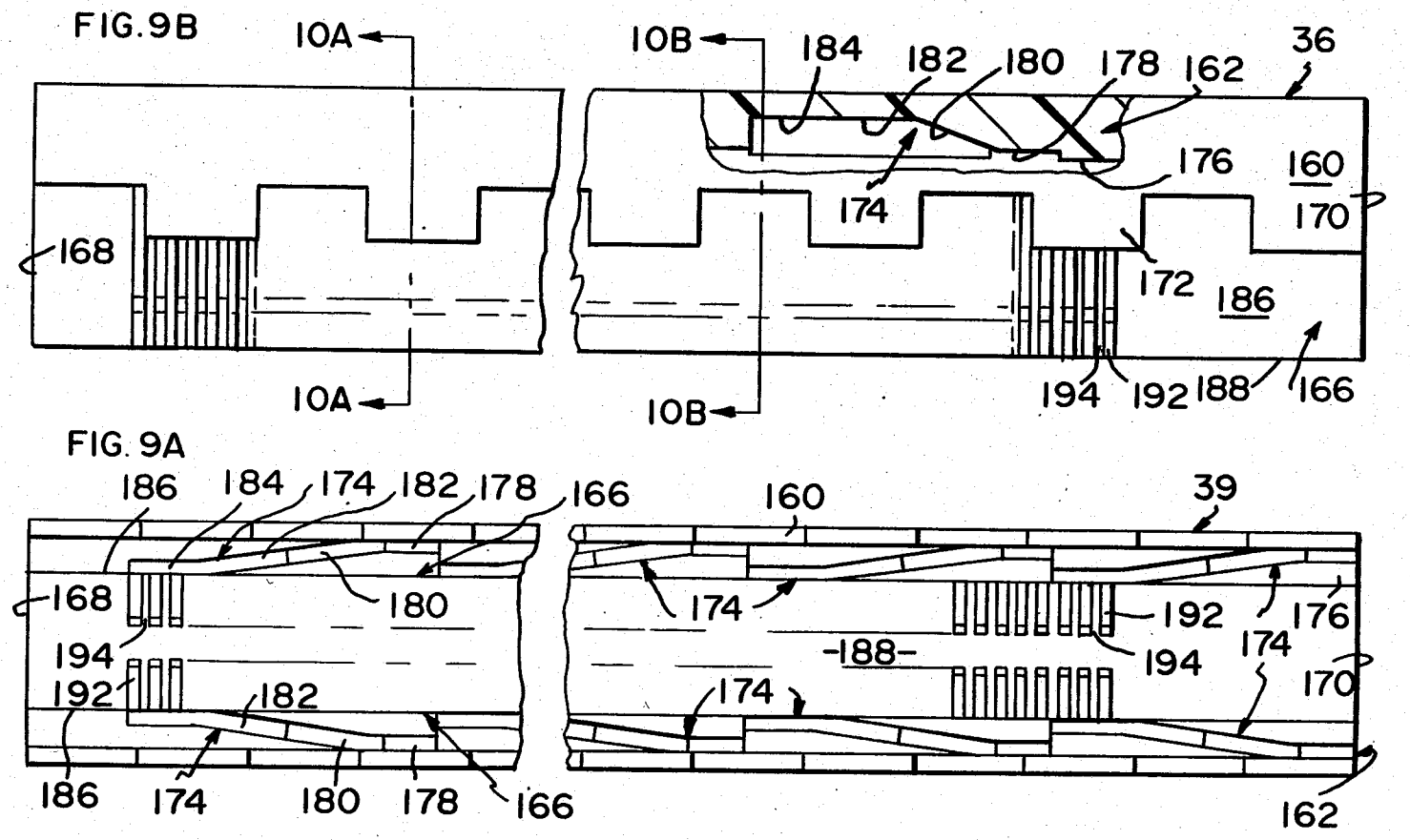
FIG. 9A is a bottom plan view looking into the upper housing of the connector.
FIG. 9B is a side, partly sectioned view of the upper housing.

As shown in FIGS. 2 and 9B, several downwardly open cam grooves 174 are provided in the downwardly facing surfaces 176 of cross members 162. Grooves 174 are provided on each side of body 166 with each groove 174 having four interconnected segments. As shown in FIGS. 9A and 10A, the former being a view looking up into grooves 174, first segments 178 are located alongside and are parallel to skirts 160. As shown in FIG. 9B particularly, first segments 178 are very shallow, extending into cross member 162 a relatively short distance. Second segments 180, as shown in FIG. 9A, angle inwardly towards the axis of upper housing 36 and, as shown in FIG. 9B, continually increase in depth between first segments 178 and third segments 182. Third segments 182 continues on the same angled path as second segment 180, without a change in its depth, to its connection with the fourth segment 184 which, as shown in FIGS. 9A and 10B, is parallel to the axis of upper housing 36 to first segments 178. Fourth segments 184 extend into cross member 182 the same distance as third segments 182.

As shown in FIGS. 9A and 9B, first segments 178 of each cam groove 174 is closer to upper housing rear end 170 and fourth segments 184 are closer to upper housing front end 168.

With reference to FIG. 2, body 166 of upper housing 36 includes sidewalls 186 joined at the lower end by base 188. Laterally and downwardly opening transverse slots 192 extend through sidewalls 186 to intersect card slot 16 and also through base 188. Transverse walls 194 separate slots 192. Slots 192 are on the same spacing as are transverse slots 72 in lower housing 28. Similarly, transverse walls 194 are on the same spacing as transverse walls 74, 76.

As shown in FIGS. 10A and 10B, spring arm retaining members 196, 198 of body 166 project upwardly into transverse slots 192 on respective sides of slot 16 from base 188. Beveled sides 200 are provided on the free ends of retaining members 196, 198 with retaining member 196 being longer and extending further up into respective transverse slot 192 relative to retaining member 198. As FIGS. 10A and 10B indicate, the positioning of retaining members 196, 198 in one set of aligned transverse slots 192 is reversed in the adjacent set of aligned transverse slots 192. As will be described below, this alternating arrangement complements the alternating arrangement of contact members 30, 32.

Transverse walls 194 electrically isolate adjacent contact members 30, 32 received in transverse slots 192.

As shown in FIG. 11, upper housing 36 fits over lower housing 28 with members 172 on skirts 160 of upper housing 36 being received in notches 98 in sidewalls 44. Cam followers 144 on top edge 146 of cam members 34 are slidingly positioned in cam grooves 174 in cross member 162. Spring arms 104 and intermediate straps 106 of contact members 30, 32 are freely received in transverse slots 192 of body 186 of upper housing 36.

With connector 10 in the open position (FIG. 11), upper housing 36 is supported by cam members 34 and with connector 10 in the closed position (FIG. 13), both cam members 34 and sidewalls 44 of lower housing 28 supply the major support of upper housing 36.

Actuating lever 38, shown in FIGS. 1 and 2, includes two parallel spaced-apart arms 202. Outwardly projecting stubs 204 are provided adjacent ends 206 of arms 202. Aligned holes 208 extend through arms 202 above and offset from stubs 204. Fastening means such as bolts 210 along lower edges 212 hold arms 202 together.

Lever 38 is pivotally mounted on lower housing 28 with arms 202 positioned on the outer sides of plates 42 and attached thereto by pin 96 in holes 94 in plates 42 and holes 208 in arms 202. Cam members 34 are attached to lever 38 by stubs 204 being slidably received in oval holes 136 of cam members 34.

Figure 12:
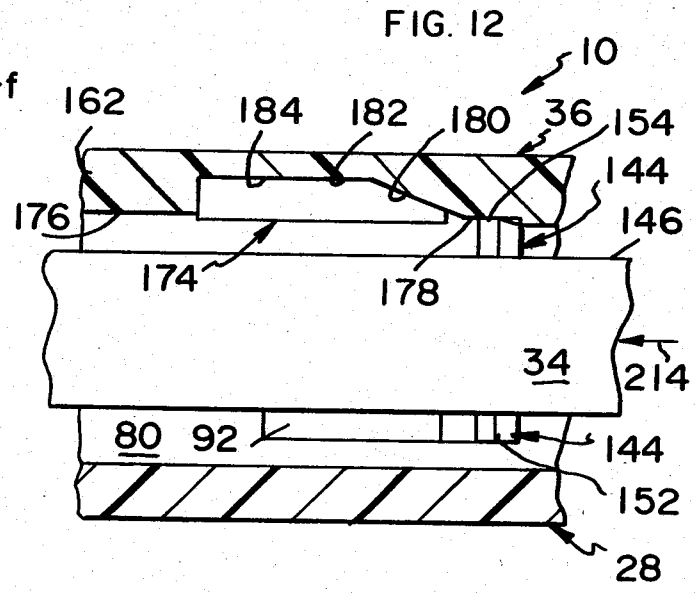
FIG. 12 is a side sectional view of a fragment of the connector showing the location of the cam member relative to a cam groove with the connector in the open state.
Figure 14:
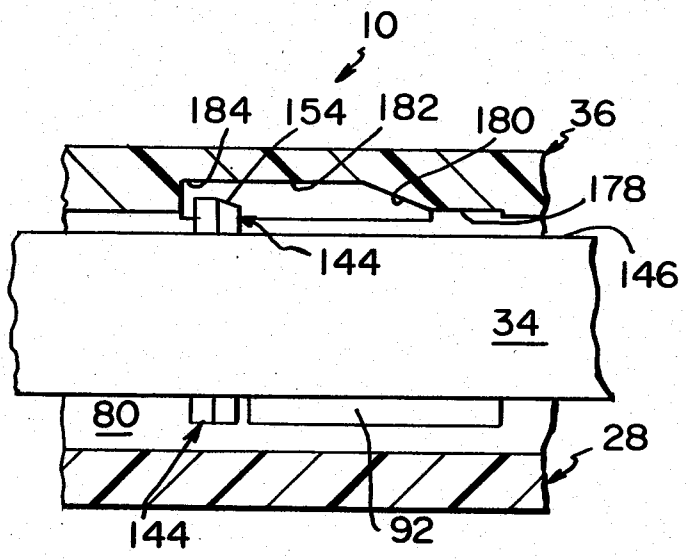
FIG. 14 is a side sectional view of a fragment of the connector showing the location of the cam member relative to a cam groove with the connector in a closed state.

FIGS. 11 and 12 are transverse and fragmentary side sectional views respectively of connector 10 when opened. FIGS. 13 and 14 are respectively corresponding views of connector 10 when closed.

With reference to FIGS. 11 and 12, spring arms 104 of contact members 30, 32 are compressively positioned in tranverse slots 192 of upper housing 36 with bearing portions 114 against cam members 34 and the outer surfaces on arcuate portions 116 bearing against beveled sides 200 of respective retaining members 196, 198. This positioning preloads spring arms 104.

Cam followers 144 on top edges 146 of cam members 34 are located in first segments 178 of cam grooves 174 which holds upper housing 36 above lower housing 28 as can be seen in FIGS. 11 and 12. Cam followers 144 on bottom edges 148 are against cam surfaces 92 on side members 80.

Leads 110 are soldered in holes 26 of backplane 12 to electrically connect contact members 30, 32 to circuits 24.

Arrow 214 in FIG. 12 indicates the direction cam members 34 are moved to close connector 10; i.e., cam followers 144 proceed from first segments 178 to fourth segments 184 of cam grooves 174.

As shown in FIG. 11, contact members 30, 32 are held out of card slot 16 by retaining members 196, 198 of upper housing 36 and accordingly, daughter card 14 may be inserted freely thereinto. Insertion of card 14 may be from above (top loaded) or from the front end (front loaded) through arms 202 and plates 42. Conventional stop means (not shown), located for example on the rear segment of card floor 54 on rear raised portion 66, locates conductive pads 20 in precise alignment with contact points 18 of spring arms 104 on respective contact members 30, 32.

Card 14 rests on the front and rear segments of card floor 54 on front and rear raised portions 56, 66 respectively of lower housing 28.

With daughter card 14 positioned in connector 10, cam members 34 are moved forward by lever 38 to close connector 10 whereby contact points 118 on contact members 30, 32 electrically engage conductive pads 20.

As cam members 34 move longitudinally forward, they also move laterally inwardly thereby also moving spring arms 104 of members 30, 32 inwardly. Further, as cam followers 144 on top edges 146 of cam members 34 leave shallow first segments 178 and move into second segments 180, preloaded spring arms 104, pushing on retaining members 196, 198, move upper housing 36 downwardly towards lower housing 28.

Under the biasing forces of the aforementioned preloading and the inwardly moving cam members 34, spring arms 104 pivot in towards card slot 16 with the primary hinge point being first arcuate portions 116. Pivoting may also occur about the second arcuate portions 122. Accordingly, contact points 118 roll into engagement with respective conductive pads 20, wiping the pads in the process.

Under continued longitudinal and lateral movement of cam members 34, spring arms 104 are compressed so that contact points 118 exert a high normal force against pads 20 to obtain the desired electrical contact therebetween. Due in part to the length of center portion 112 of spring arms 104 which comprises a first moment arm, the pivoting about arcuate portion 116 and intermediate straps 106 which comprise a second moment arm, a mechanical advantage of about three to one is obtained.

Accordingly, less force is required to move cam members 34 while still obtaining a high normal force against pads 20.

Compression of spring arms 104 occurs from respective cam followers 144 moving through second and third segments 180, 182 respectively of cam grooves 174 and cam surfaces 92 on side members 80. The compressed spring arms 104 are held or locked in position by respective cam followers 144 being moved into fourth segments 184 and onto side members 80 as shown in FIG. 14.

As cam members 34 move laterally in the forward direction to close connector 10, beveled surfaces **152-*f* of respective cam followers 144 engage the outside sidewalls of cam grooves 174, i.e., those nearest skirts 160, and cam surfaces 92**.

Upper housing 36, which otherwise would move longitudinally by the drag between cam followers 144 and cam grooves 174, is prevented therefrom by skirt members 172 being in notches 98 of lower housing sidewalls 44.

In summary, four action steps occur through moving cam members 34 in closing connector 10: (1) lowering upper housing 36 to free spring arms 104 by displacing restraining members 196, 198; (2) engaging and wiping conductive pads 20 by contact points 118; (3) compressing spring arms 104 to obtain the desired normal force against pads 20; and (4) locking the compressed spring arms 104 in position.

Moving cam members 34 longitudinally rearwardly opens connector 10 with the above-noted action steps occurring in the reverse order. The force in moving cam members 34 laterally is the compressed forces in spring arms 104. Beveled surfaces **152-*r* of respective cam followers 144 engage the outer sidewalls of cam grooves 174 and cam surfaces 92 of side members 80. Also, beveled surfaces 154 on the faces of cam followers 144 on top edges 146 engage the sloping floors of second segments 180 of cam grooves 174**.

As can be discerned, a zero insertion force, card edge connector has been disclosed which includes contact members having spring arms which provide a mechanical advantage so that the force required to actuate the camming mechanism is reduced without a loss in the desired normal force applied against conductive pads on a daughter card inserted therein. The connector includes a lower housing in which the contact members are positioned and a vertically movable upper housing in which the spring arms are received on each side of a card slot. Restraining members in the upper housing holds the spring arms away from the card slot so that the daughter card may be inserted freely thereinto. Cam members, slidably positioned between the upper and lower housings, are moved longitudinally to lower the upper housing so as to remove the restraining members from interference with the spring arms and to compress the spring arms so that contact points thereon engage conductive pads on the card with a high normal force.

Further, the contact members include a first configuration in which the contact point is positioned at one vertical location with respect to the card slot and a second configuration in which the contact point is positioned at a second vertical location with respect to the card slot. This vertical staggered arrangement accommodates daughter cards having two rows of conductive pads on each edge with each row on each side being staggered with respect to each other, and the rows on one side being staggered with respect to the rows on the opposite side.

I claim:

1. A zero insertion force, card edge connector for mounting on a backplane and receiving a daughter card therein to electrically interconnect conductive means on the backplane and daughter card, said connector comprising:

dielectric lower housing means having receiving means for receiving conductive contact means;

dielectric upper housing means positioned over said lower housing means for movement towards and away therefrom, said upper housing means having body means and cross member means on top and extending laterally over both sides of said body means, and with a longitudinal card slot extending through said cross member means and into said body means, said body means having transverse slots on both sides of and intersecting said card slot and opening out onto the sides and undersurface of said body means, said cross member means having downwardly open cam groove means positioned therein and located adjacent each side of said body means;

said contact means having lead means at one end and a C-shaped spring means at another end with contact member means thereon and bearing means at a free end thereof, said contact means being positioned in said receiving means in said lower housing means with said lead means extending outwardly from an underside thereof for electrical engagement with conductive means on the backplane and said spring means extending into said transverse slots in said upper housing means with said contact member means facing towards said card slot and said bearing means projecting out through the sides of said body means; and cam means slidably positioned on said lower housing means and alongside said body means of said upper housing means and bearing against said bearing means of said spring means and further having cam follower means extending into said cam groove means in said cross member means so that by moving said cam means longitudinally, cooperation between said cam follower means and said cam groove means moves said cam means and said bearing means towards said card slot, forcing said contact member means into said card slot and into electrical engagement with conductive means on the daughter card that has been disposed therein.

2. The connector of claim 1 further including restraining means in said body means for restraining said contact member means from entering said card slot and means in said cam groove means cooperating with said cam follower means for removably retaining said restraining means in position restraining said contact member means.

3. The connector of claim 2 wherein said spring means of said contact means are compressed between said cam means and said restraining means when said restraining means are restraining said contact member means from entering said card slot.

4. The connector of claim 3 further including release means in said cam groove means for cooperating with said cam follower means and said compressed spring means for releasing said restraining means from restraining said contact member means.

5. The connector of claim 1 further including cam surface means in said lower housing means and other cam follower means on said cam means for engaging said cam surface means to assist said cam follower means in said cam groove means in moving said cam means towards said card slot.

6. The connector of claim 1 wherein a hinge section connects said spring means to strap means positioned intermediate said spring means and said lead means so that said contact member means rollingly engage said conductive means on the daughter card when forced into said card slot.

7. The connector of claim 6 wherein said spring means are C-shaped with the bearing means formed from the free end being curved around.

8. The connector of claim 7 wherein said hinge section includes a first arcuate portion with said contact member means including an embossed point on the outer surface thereof.

9. The connector of claim 8 further including a second arcuate portion between and connected to said first arcuate portion and said strap means and providing a secondary hinge section.

10. The connector of claim 9 wherein said spring means further includes a straight center portion between said first arcuate portion and said bearing means with said center portion providing a moment arm.

11. The connector of claim 10 wherein said strap means provides a second moment arm.

12. The connector of claim 1 wherein said contact means include retention means of retaining said electrical contact means in said receiving means in said lower housing means, said retention means being between said lead means and said spring means.

13. The connector of claim 12 wherein said receiving means in said lower housing means include transverse wall means defined by transverse slots and said retention means on said contact means includes a U-shaped retention section having an open slot defined by first and second parallel spaced-apart legs connected by a bight, said retention section positioned on a transverse wall means which is frictionally received in said slot.

14. The connector of claim 13 further including intermediate strap means between said retention section and said spring means, and some of said contact means constitute first contact means, and other of said contact means constitute second contact means.

15. The connector of claim 14 wherein said strap means of said first contact means is attached to said first parallel leg of said retention section thereon and said strap means on said second contact means is attached to said second parallel leg of said retention section thereon.

16. The connector of claim 15 wherein said transverse wall means are positioned in two longitudinal rows in said lower housing means with a center member therebetween.

17. The connector of claim 16 wherein each transverse wall means receives one of said first contact means and one of said second contact means thereon with said strap means of said first contact means extending along one side of said transverse wall means and said strap means of said second contact means extending along another side of said transverse wall means.

18. The connector of claim 17 wherein said contact member means on said spring means of said first contact means is located at a different vertical position relative to the location of said contact member means on said spring means of said second contact means.

19. The connector of claim 18 wherein said first contact means is positioned on said transverse wall means adjacent said center member and said second contact means is positioned on said transverse wall means between said first contact means and a sidewall of said lower housing means.

20. The connector of claim 19 wherein said contact member means on said spring means of said first contact means positioned on one transverse wall means faces said contact member means on said spring means of said second contact means positioned on another transverse wall means located directly across said center member.

21. The connector of claim 20 wherein said cam means, in forcing said contact member means into said card slot, compresses said spring means whereby said contact member means exert a normal force against said conductive means on the daughter card.

22. The connector of claim 21 wherein said cam groove means include means for removably locking said cam member means against said compressed spring means.

* * * * *